US009478221B2

(12) United States Patent
Bruhn

(10) Patent No.: US 9,478,221 B2
(45) Date of Patent: Oct. 25, 2016

(54) ENHANCED AUDIO FRAME LOSS CONCEALMENT

(71) Applicant: Telefonaktiebolaget L M Ericsson (publ), Stockholm (SE)

(72) Inventor: Stefan Bruhn, Sollentuna (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 14/764,287

(22) PCT Filed: Jan. 22, 2014

(86) PCT No.: PCT/SE2014/050066

§ 371 (c)(1),
(2) Date: Jul. 29, 2015

(87) PCT Pub. No.: WO2014/123469

PCT Pub. Date: Aug. 14, 2014

(65) Prior Publication Data

US 2015/0371641 A1 Dec. 24, 2015

Related U.S. Application Data

(60) Provisional application No. 61/760,822, filed on Feb. 5, 2013.

(51) Int. Cl.
*G10L 19/02* (2013.01)
*G10L 19/005* (2013.01)
(Continued)

(52) U.S. Cl.
CPC ..... *G10L 19/005* (2013.01); *G10L 19/04* (2013.01); *G10L 25/69* (2013.01)

(58) Field of Classification Search
USPC ..... 704/263–269
See application file for complete search history.

(56) References Cited

U.S. PATENT DOCUMENTS 7,388,853 B2 6/2008 Ptasinski
7,822,005 B2 10/2010 Ptasinski
(Continued)

FOREIGN PATENT DOCUMENTS

EP 1 722 359 A1 11/2006
KR 10-2005-0091034 A 9/2005
(Continued)

OTHER PUBLICATIONS

International Search Report, Application No. PCT/SE2014/050066, Jun. 18, 2014.
(Continued)

*Primary Examiner* — Marcellus Augustin
(74) *Attorney, Agent, or Firm* — Myers Bigel & Sibley, P.A.

(57) ABSTRACT

A method is provided for concealing a lost audio frame of a received audio signal by performing a sinusoidal analysis of a part of a previously received or reconstructed audio signal. The sinusoidal analysis involves identifying frequencies of sinusoidal components of the audio signal, and applying a sinusoidal model on a segment of the previously received or reconstructed audio signal. The segment is used as a prototype frame in order to create a substitution frame for a lost audio frame. The method includes creating the substitution frame for the lost audio frame by time-evolving sinusoidal components of the prototype frame, up to the time instance of the lost audio frame, in response to the corresponding identified frequencies. The method further includes performing at least one of an enhanced frequency estimation and an adaptation of the creating of the substitution frame in response to the tonality of the audio signal.

35 Claims, 8 Drawing Sheets

(51) Int. Cl.
*G10L 19/04* (2013.01)
*G10L 25/69* (2013.01)

(56) References Cited

U.S. PATENT DOCUMENTS

| | | | |
|---|---|---|---|
| 9,293,144 | B2 | 3/2016 | Bruhn et al. |
| 2002/0041570 | A1 | 4/2002 | Ptasinski |
| 2004/0002856 | A1 | 1/2004 | Bhaskar |
| 2004/0122680 | A1 | 6/2004 | McGowan et al. |
| 2005/0058145 | A1 | 3/2005 | Florencio et al. |
| 2007/0124136 | A1 | 5/2007 | Den Brinker |
| 2007/0147518 | A1 | 6/2007 | Bessette |
| 2007/0225971 | A1 | 9/2007 | Bessette |
| 2007/0282603 | A1 | 12/2007 | Bessette |
| 2008/0236506 | A1 | 10/2008 | Conger |
| 2008/0275695 | A1 | 11/2008 | Ramo |
| 2010/0057467 | A1 | 3/2010 | Wouters |
| 2010/0318349 | A1 | 12/2010 | Kovesi et al. |

FOREIGN PATENT DOCUMENTS

| | | | |
|---|---|---|---|
| KR | 10-2009-0082415 | A | 7/2009 |
| WO | WO 2004/059894 | A2 | 7/2004 |
| WO | WO 2006/079348 | A1 | 8/2006 |

OTHER PUBLICATIONS

Written Opinion of the International Searching Authority, Application No. PCT/SE2014/050066, Jun. 18, 2014.

Bartkowiak et al., "Mitigation of Long Gaps in Music Using Hybrid Sinusoidal+Noise Model with Context Adaptation", *ICSES 2010—The International Conference on Signals and Electronic Systems*, Gliwice, Poland, Sep. 7-10, 2010, pp. 435-438.

Hou et al., "Real-time Audio Error Concealment Method Based on Sinusoidal Model", *ICALIP 2008—International Conference on Audio, Language and Image Processing*, Piscataway, NJ, Jul. 7, 2008, pp. 22-28.

McAulay et al., "Speech Analysis/Synthesis Based on Sinusoidal Representation", *IEEE Transactions on Acoustics, Speech, and Signal Processing*, vol. ASSP-34, No. 4, Aug. 1986, pp. 744-754.

Serra et al., "Spectral Modeling Synthesis: A Sound Analysis/Synthesis System Based on a Deterministic plus Stochastic Decomposition", *Computer Music Journal*, vol. 14, No. 4, Winter Jan. 1990, pp. 12-24.

Smith et al., "PARSHL: An Analysis/Synthesis Program for Non-Harmonic Sounds Based on Sinusoidal Representation", *Proceedings of the 1987 International Computer Music Conference*, University of Illinois at Urbana-Champaign, Aug. 23-26, 1987, pp. 290-297.

International Preliminary Report on Patentability, Application No. PCT/SE2014/050067, Jun. 2, 2015.

International Preliminary Report on Patentability, Application No. PCT/SE2014/050068, May 22, 2015.

International Search Report, PCT Application No. PCT/SE2014/050068, Jun. 18, 2014.

Japanese Office Action, corresponding to Japanese Patent Application No. 2015-555963, 4 pages.

Lemyre et al., "New Approach to Voiced Onset Detection in Speech Signal and Its Application for Frame Error Concealment", *IEEE International Conference on Acoustics, Speech and Signal Processing, 2008. ICASSP 2008*, Las Vegas, NV, Mar. 31-Apr. 4, 2008, pp. 4757-4760.

Lindblom et al., "Packet Loss Concealment Based on Sinusoidal Extrapolation", *2002 IEEE International Conference on Acoustics, Speech, and Signal Processing* (*ICASSP*), Orlando, Florida, May 13-17, 2002, pp. I-173-I-176.

Notice of Preliminary Rejection, Korean Application No. 10-2015-7024184, Oct. 8, 2015.

Quatieri et al., "Audio Signal Processing Based on Sinusoidal Analysis/Synthesis", In: *Applications of Digital Signal Processing to Audio and Acoustics*, Mark Kahrs et al., ed., Dec. 31, 2002, p. 371.

Ricard, "An Implementation of Multi-Band Onset Detection", *Proceedings of the 1st Annual Music Information Retrieval Evaluation eXchange* (*MIREX*), Sep. 15, 2005, retrieved from the Internet: URL:http://www.music-ir.org/evaluation/mirex-results/articles/onset/ricard.pdf, 4 pp.

Wang et al., "An Efficient Transient Audio Coding Algorithm based on DCT and Matching Pursuit", *2010 3rd International Congress on Image and Signal Processing* (*CISP 2010*), Yantai, China, Oct. 16-18, 2010, pp. 3082-3085.

Written Opinion of the International Searching Authority, PCT Application No. PCT/SE2014/050068, Jun. 18, 2014.

Written Opinion of the International Searching Authority, PCT Application No. PCT/SE2014/050068, Feb. 13, 2015.

Korean Notice of Preliminary Rejection, Application No. 10-2015-7022751, Oct. 8, 2015.

International Search Report, Application No. PCT/SE2014/050067, Jun. 18, 2014.

Written Opinion of the International Searching Authority, Application No. PCT/SE2014/050067, Jun. 18, 2014.

International Preliminary Report on Patentability, Application No. PCT/SE2014/050067, May 22, 2015.

Notice of Final Rejection, Korean Patent Application No. 10-2009-0082415, Mar. 14, 2016.

Japanese Office Action for Japanese Patent Application No. 2015-555963, dated Mar. 14, 2016.

Notice of Final Rejection, Korean Application No. 2015-7022751, dated May 25, 2016.

Notice of Acceptance, New Zealand Patent No. 709639, dated Jun. 9, 2016.

ENHANCED AUDIO FRAME LOSS CONCEALMENT

CROSS REFERENCE TO RELATED APPLICATIONS

This application is a 35 U.S.C. §371 national stage application of PCT International Application No. PCT/SE2014/050066, filed on 22 Jan. 2014, which itself claims priority to U.S. provisional Application No. 61/760,822, filed 5 Feb. 2013, the disclosure and content of both of which are incorporated by reference herein in its entirety. The above-referenced PCT International Application was published in the English language as International Publication No. WO 2014/123469 A1 on 14 Aug. 2014.

TECHNICAL FIELD

The invention relates generally to a method of concealing a lost audio frame of a received coded audio signal. The invention also relates to a decoder configured to conceal a lost audio frame of a received coded audio signal. The invention further relates to a receiver comprising a decoder, and to a computer program and a computer program product.

BACKGROUND

A conventional audio communication system transmits speech and audio signals in frames, meaning that the sending side first arranges the audio signal in short segments, i.e. audio signal frames, of e.g. 20-40 ms, which subsequently are encoded and transmitted as a logical unit in e.g. a transmission packet. A decoder at the receiving side decodes each of these units and reconstructs the corresponding audio signal frames, which in turn are finally output as a continuous sequence of reconstructed audio signal samples.

Prior to the encoding, an analog to digital (A/D) conversion may convert the analog speech or audio signal from a microphone into a sequence of digital audio signal samples. Conversely, at the receiving end, a final D/A conversion step typically converts the sequence of reconstructed digital audio signal samples into a time-continuous analog signal for loudspeaker playback.

However, a conventional transmission system for speech and audio signals may suffer from transmission errors, which could lead to a situation in which one or several of the transmitted frames are not available at the receiving side for reconstruction. In that case, the decoder has to generate a substitution signal for each unavailable frame. This may be performed by a so-called audio frame loss concealment unit in the decoder at the receiving side. The purpose of the frame loss concealment is to make the frame loss as inaudible as possible, and hence to mitigate the impact of the frame loss on the quality of the reconstructed signal.

Conventional frame loss concealment methods may depend on the structure or the architecture of the codec, e.g. by repeating previously received codec parameters. Such parameter repetition techniques are clearly dependent on the specific parameters of the used codec, and may not be easily applicable to other codecs with a different structure. Current frame loss concealment methods may e.g. freeze and extrapolate parameters of a previously received frame in order to generate a substitution frame for the lost frame.

The standardized linear predictive codecs AMR and AMR-WB are parametric speech codecs which freeze the earlier received parameters or use some extrapolation thereof for the decoding. In essence, the principle is to have a given model for coding/decoding and to apply the same model with frozen or extrapolated parameters.

Many audio codecs apply for coding a frequency domain-technique, which involves applying a coding model on a spectral parameter after a frequency domain transform. The decoder reconstructs the signal spectrum from the received parameters and transforms the spectrum back to a time signal. Typically, the time signal is reconstructed frame by frame, and the frames are combined by overlap-add techniques and potential further processing to form the final reconstructed signal. The corresponding audio frame loss concealment applies the same, or at least a similar, decoding model for lost frames, wherein the frequency domain parameters from a previously received frame are frozen or suitably extrapolated and then used in the frequency-to-time domain conversion.

However, conventional audio frame loss concealment methods may suffer from quality impairments, e.g. since the parameter freezing and extrapolation technique and re-application of the same decoder model for lost frames may not always guarantee a smooth and faithful signal evolution from the previously decoded signal frames to the lost frame. This may lead to audible signal discontinuities with a corresponding quality impact. Thus, audio frame loss concealment with reduced quality impairment is desirable and needed.

SUMMARY

The object of embodiments of the present invention is to address at least some of the problems outlined above, and this object and others are achieved by the method and the arrangements according to the appended independent claims, and by the embodiments according to the dependent claims.

According to one aspect, embodiments provide a method for concealing a lost audio frame of a received audio signal, the method comprising a sinusoidal analysis of a part of a previously received or reconstructed audio signal, wherein the sinusoidal analysis involves identifying frequencies of sinusoidal components of the audio signal. Further, a sinusoidal model is applied on a segment of the previously received or reconstructed audio signal, wherein said segment is used as a prototype frame in order to create a substitution frame for a lost audio frame. The creation of the substitution frame involves time-evolution of sinusoidal components of the prototype frame, up to the time instance of the lost audio frame, based on the corresponding identified frequencies. Further, at least one of an enhanced frequency estimation in the identifying of frequencies, and an adaptation of the creating of the substitution frame in response to the tonality of the audio signal, is performed, wherein the enhanced frequency estimation comprises at least one of a main lobe approximation, a harmonic enhancement, and an interframe enhancement.

According to a second aspect, embodiments provide a decoder configured to conceal a lost audio frame of a received audio signal, the decoder comprising a processor and memory, the memory containing instructions executable by the processor, whereby the decoder is configured to perform a sinusoidal analysis of a part of a previously received or reconstructed audio signal, wherein the sinusoidal analysis involves identifying frequencies of sinusoidal components of the audio signal. The decoder is configured to apply a sinusoidal model on a segment of the previously received or reconstructed audio signal, wherein said segment is used as a prototype frame in order to create a substitution frame for a lost audio frame, and to create the substitution frame by time evolving sinusoidal components of the prototype frame, up to the time instance of the lost audio frame, in response to the corresponding identified frequencies. Further, the decoder is configured to perform at least one of an enhanced frequency estimation in the identifying of frequencies, and an adaptation of the creating of the substitution frame in response to the tonality of the audio signal, wherein the enhanced frequency estimation comprises at least one of a main lobe approximation, a harmonic enhancement, and an interframe enhancement.

According to a third aspect, embodiments provide a decoder configured to conceal a lost audio frame of a received audio signal, the decoder comprising an input unit configured to receive an encoded audio signal, and a frame loss concealment unit. The frame loss concealment unit comprises means for performing a sinusoidal analysis of a part of a previously received or reconstructed audio signal, wherein the sinusoidal analysis involves identifying frequencies of sinusoidal components of the audio signal. The frame loss concealment unit also comprises means for applying a sinusoidal model on a segment of the previously received or reconstructed audio signal, wherein said segment is used as a prototype frame in order to create a substitution frame for a lost audio frame. The frame loss concealment unit further comprises means for creating the substitution frame for the lost audio frame by time-evolving sinusoidal components of the prototype frame, up to the time instance of the lost audio frame, in response to the corresponding identified frequencies, and means for performing at least one of an enhanced frequency estimation in the identifying of frequencies, and an adaptation of the creating of the substitution frame in response to the tonality of the audio signal, wherein the enhanced frequency estimation comprises at least one of a main lobe approximation, a harmonic enhancement, and an interframe enhancement.

The decoder may be implemented in a device, such as e.g. a mobile phone.

According to a fourth aspect, embodiments provide a receiver comprising a decoder according to any of the second and the third aspects described above.

According to a fifth aspect, embodiments provide a computer program being defined for concealing a lost audio frame, wherein the computer program comprises instructions which when run by a processor causes the processor to conceal a lost audio frame, in agreement with the first aspect described above.

According to a sixth aspect, embodiments provide a computer program product comprising a computer readable medium storing a computer program according to the above-described fifth aspect.

An advantage with embodiments described herein is to provide a frame loss concealment method that mitigates the audible impact of frame loss in the transmission of audio signals, e.g. of coded speech. A general advantage is to provide a smooth and faithful evolution of the reconstructed signal for a lost frame, wherein the audible impact of frame losses is greatly reduced in comparison to conventional techniques.

Further features and advantages of the teachings in the embodiments of the present application will become clear upon reading the following description and the accompanying drawings.

BRIEF DESCRIPTION OF THE DRAWINGS

The embodiments will be described in more detail and with reference to the accompanying drawings, in which.

DETAILED DESCRIPTION

Figure 1:
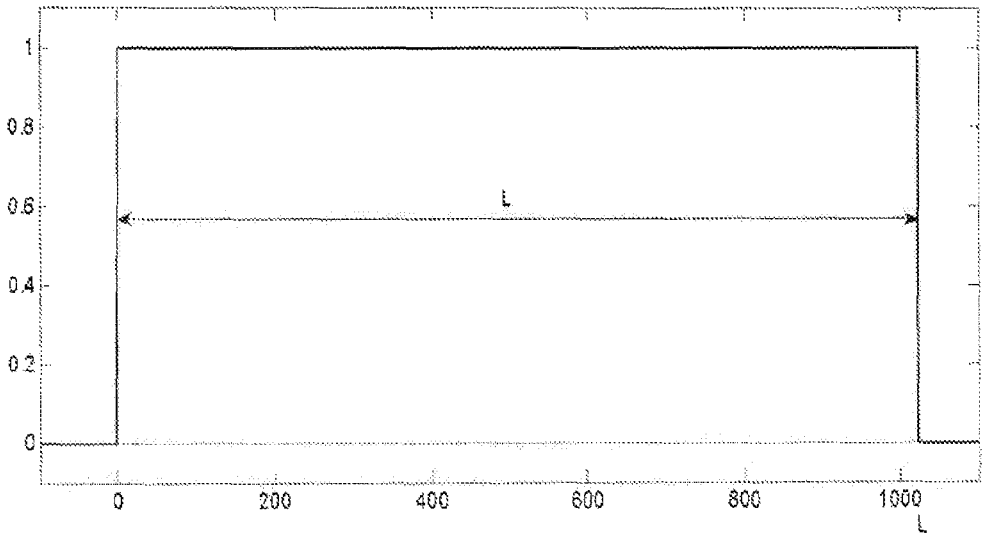
FIG. 1 illustrates a typical window function.

In the following, embodiments of the invention will be described in more detail. For the purpose of explanation and not limitation, specific details are disclosed, such as particular scenarios and techniques, in order to provide a thorough understanding.

Moreover, it is apparent that the exemplary method and devices described below may be implemented, at least partly, by the use of software functioning in conjunction with a programmed microprocessor or general purpose computer, and/or using an application specific integrated circuit (ASIC). Further, the embodiments may also, at least partly, be implemented as a computer program product or in a system comprising a computer processor and a memory coupled to the processor, wherein the memory is encoded with one or more programs that may perform the functions disclosed herein.

A concept of the embodiments described hereinafter comprises concealing a lost audio frame by:

- performing a sinusoidal analysis of at least part of a previously received or reconstructed audio signal, wherein the sinusoidal analysis involves identifying frequencies of sinusoidal components of the audio signal;
- applying a sinusoidal model on a segment of the previously received or reconstructed audio signal, wherein said segment is used as a prototype frame in order to create a substitution frame for a lost frame;
- creating the substitution frame for the lost audio frame, involving a time-evolution of sinusoidal components of the prototype frame, up to the time instance of the lost audio frame, based on the corresponding identified frequencies, and
- performing at least one of an enhanced frequency estimation in the identifying of frequencies, and an adaptation of the creating of the substitution frame in response to the tonality of the audio signal, wherein the enhanced frequency estimation comprises at least one of a main lobe approximation, a harmonic enhancement, and an interframe enhancement.

Sinusoidal Analysis

The frame loss concealment according to embodiments involves a sinusoidal analysis of a part of a previously received or reconstructed audio signal. The purpose of this sinusoidal analysis is to find the frequencies of the main sinusoidal components, i.e. sinusoids, of that signal. Hereby, the underlying assumption is that the audio signal was generated by a sinusoidal model and that it is composed of a limited number of individual sinusoids, i.e. that it is a multi-sine signal of the following type:

$$s(n) = \sum_{k=1}^{K} a_k \cdot \cos\left(2\pi \frac{f_k}{f_s} \cdot n + \varphi_k\right). \tag{6.1}$$

In this equation K is the number of sinusoids that the signal is assumed to consist of. For each of the sinusoids with index k=1 . . . K, $a_k$ is the amplitude, $f_k$ is the frequency, and $\phi_k$ is the phase. The sampling frequency is denominated by $f_s$ and the time index of the time discrete signal samples s(n) by n.

It is important to find as exact frequencies of the sinusoids as possible. While an ideal sinusoidal signal would have a line spectrum with line frequencies $f_k$, finding their true values would in principle require infinite measurement time. Hence, it is in practice difficult to find these frequencies, since they can only be estimated based on a short measurement period, which corresponds to the signal segment used for the sinusoidal analysis according to embodiments described herein; this signal segment is hereinafter referred to as an analysis frame. Another difficulty is that the signal may in practice be time-variant, meaning that the parameters of the above equation vary over time. Hence, on the one hand it is desirable to use a long analysis frame making the measurement more accurate, and on the other hand a short measurement period would be needed in order to better cope with possible signal variations. A good trade-off is to use an analysis frame length in the order of e.g. 20-40 ms.

According to a preferred embodiment, the frequencies of the sinusoids $f_k$ are identified by a frequency domain analysis of the analysis frame. To this end, the analysis frame is transformed into the frequency domain, e.g. by means of DFT (Discrete Fourier Transform) or DCT (Discrete Cosine Transform), or a similar frequency domain transform. In case a DFT of the analysis frame is used, the spectrum is given by:

$$X(m) = DFT(w(n) \cdot x(n)) = \sum_{n=0}^{L-1} e^{-j\frac{2\pi}{L}mn} \cdot w(n) \cdot x(n). \tag{6.2}$$

In this equation, w(n) denotes the window function with which the analysis frame of length L is extracted and weighted.

FIG. 1 illustrates a typical window function, i.e. a rectangular window which is equal to 1 for n∈[0 . . . L−1] and otherwise 0. It is assumed that the time indexes of the previously received audio signal are set such that the prototype frame is referenced by the time indexes n=0 . . . L−1. Other window functions that may be more suitable for spectral analysis are e.g. Hamming, Hanning, Kaiser or Blackman.

Figure 2:
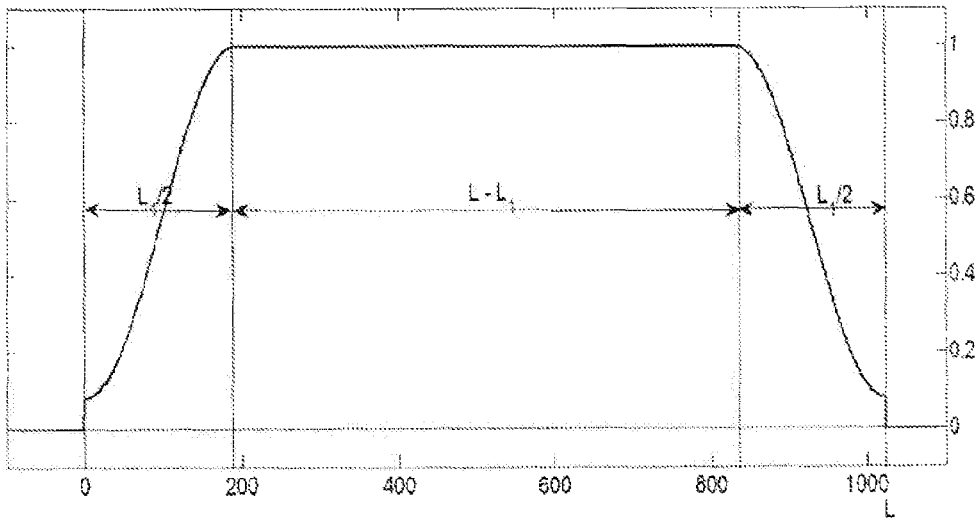
FIG. 2 illustrates a specific window function.

FIG. 2 illustrates a more useful window function, which is a combination of the Hamming window and the rectangular window. The window illustrated in FIG. 2 has a rising edge shape like the left half of a Hamming window of length L1 and a falling edge shape like the right half of a Hamming window of length L1 and between the rising and falling edges the window is equal to 1 for the length of L-L1.

The peaks of the magnitude spectrum of the windowed analysis frame |X(m)| constitute an approximation of the required sinusoidal frequencies $f_k$. The accuracy of this approximation is however limited by the frequency spacing of the DFT. With the DFT with block length L the accuracy is limited to $$\frac{f_s}{2L}.$$

However, this level of accuracy may be too low in the scope of the method according the embodiments described herein, and an improved accuracy can be obtained based on the results of the following consideration:

The spectrum of the windowed analysis frame is given by the convolution of the spectrum of the window function with the line spectrum of a sinusoidal model signal S(Ω), subsequently sampled at the grid points of the DFT:

$$X(m) = \int_{2\pi} \delta\left(\Omega - m \cdot \frac{2\pi}{L}\right) \cdot (W(\Omega) * S(\Omega)) \cdot d\Omega. \tag{6.3}$$

By using the spectrum expression of the sinusoidal model signal, this can be written as $$X(m) = \frac{1}{2} \int_{2\pi} \delta\left(\Omega - m \cdot \frac{2\pi}{L}\right) \cdot \sum_{k=1}^{K} a_k \cdot \left(\left(W\left(\Omega + 2\pi \frac{f_k}{f_s}\right) \cdot e^{-j\varphi_k} + W\left(\Omega - 2\pi \frac{f_k}{f_s}\right) \cdot e^{j\varphi_k}\right) \cdot d\Omega \tag{6.4}$$

Hence, the sampled spectrum is given by $$X(m) = \frac{1}{2} \sum_{k=1}^{K} a_k \cdot \left(\left(W\left(2\pi\left(\frac{m}{L} + \frac{f_k}{f_s}\right)\right) \cdot e^{-j\varphi_k} + W\left(2\pi\left(\frac{m}{L} - \frac{f_k}{f_s}\right)\right) \cdot e^{j\varphi_k}\right)\right), \quad \text{with } m = 0 \ldots L-1. \tag{6.5}$$

Based on this consideration it is assumed that the observed peaks in the magnitude spectrum of the analysis frame stem from a windowed sinusoidal signal with K sinusoids where the true sinusoid frequencies are found in the vicinity of the peaks. Thus, the identifying of frequencies of sinusoidal components may further involve identifying frequencies in the vicinity of the peaks of the spectrum related to the used frequency domain transform.

If $m_k$ is assumed to be a DFT index (grid point) of the observed $k^{th}$ peak, then the corresponding frequency is $$\hat{f}_k = \frac{m_k}{L} \cdot f_s$$

which can be regarded an approximation of the true sinusoidal frequency $f_k$. The true sinusoid frequency $f_k$ can be assumed to lie within the interval $$\left[(m_k - 1/2)\cdot\frac{f_s}{L}, (m_k + 1/2)\cdot\frac{f_s}{L}\right].$$

Figure 4:
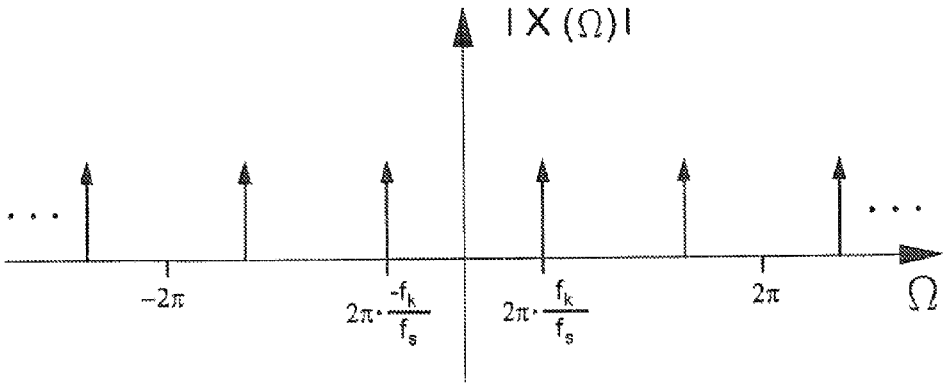
FIG. 4 illustrates a line spectrum of an exemplary sinusoidal signal with the frequency $f_k$.
Figure 5:
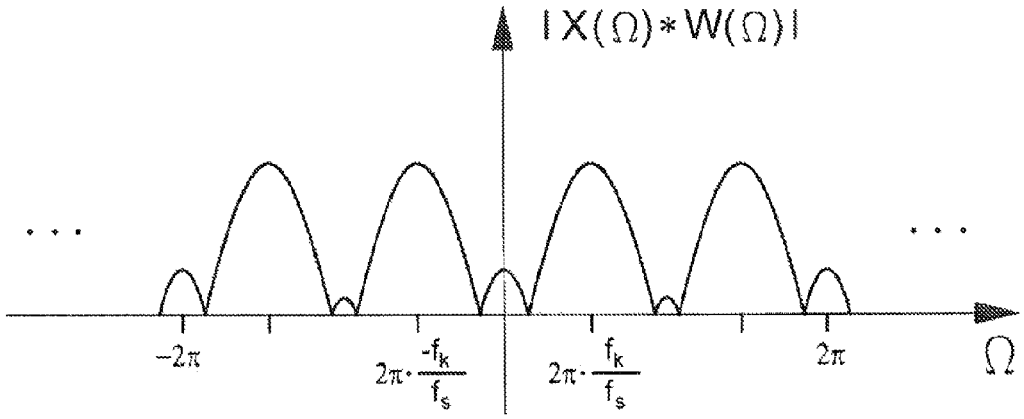
FIG. 5 shows a spectrum of a windowed sinusoidal signal with the frequency $f_k$.

For clarity it is noted that the convolution of the spectrum of the window function with the spectrum of the line spectrum of the sinusoidal model signal can be understood as a superposition of frequency-shifted versions of the window function spectrum, whereby the shift frequencies are the frequencies of the sinusoids. This superposition is then sampled at the DFT grid points. The convolution of the spectrum of the window function with the spectrum of the line spectrum of the sinusoidal model signal are illustrated in the FIG. 3-FIG. 7, of which FIG. 3 displays an example of the magnitude spectrum of a window function, and FIG. 4 the magnitude spectrum (line spectrum) of an example sinusoidal signal with a single sinusoid with a frequency $f_k$. FIG. 5 shows the magnitude spectrum of the windowed sinusoidal signal that replicates and superposes the frequency-shifted window spectra at the frequencies of the sinusoid, and the bars in FIG. 6 correspond to the magnitude of the grid points of the DFT of the windowed sinusoid that are obtained by calculating the DFT of the analysis frame. Note that all spectra are periodic with the normalized frequency parameter $\Omega$ where $\Omega=2\pi$ that corresponds to the sampling frequency $f_s$.

Figure 6:
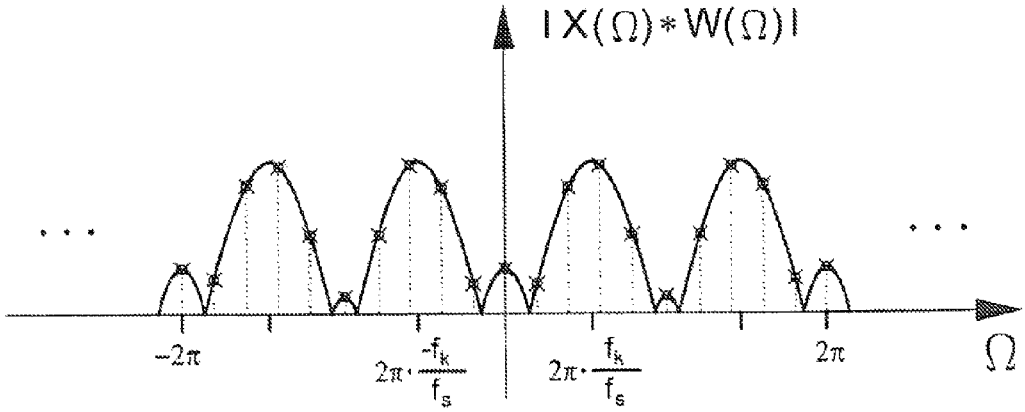
FIG. 6 illustrates bars corresponding to the magnitude of grid points of a DFT, based on an analysis frame.

Based on the above discussion, and based on the illustration in FIG. 6, a better approximation of the true sinusoidal frequencies may be found by increasing the resolution of the search, such that it is larger than the frequency resolution of the used frequency domain transform.

Thus, the identifying of frequencies of sinusoidal components is preferably performed with higher resolution than the frequency resolution of the used frequency domain transform, and the identifying may further involve interpolation.

One exemplary preferred way to find a better approximation of the frequencies $f_k$ of the sinusoids is to apply parabolic interpolation. One approach is to fit parabolas through the grid points of the DFT magnitude spectrum that surround the peaks and to calculate the respective frequencies belonging to the parabola maxima, and an exemplary suitable choice for the order of the parabolas is 2. In more detail, the following procedure may be applied:

1) Identifying the peaks of the DFT of the windowed analysis frame. The peak search will deliver the number of peaks K and the corresponding DFT indexes of the peaks. The peak search can typically be made on the DFT magnitude spectrum or the logarithmic DFT magnitude spectrum.

2) For each peak k (with k=1 . . . K) with corresponding DFT index $m_k$, fitting a parabola through the three points $\{P_1;\ P_2;\ P_3\}=\{(m_k-1,\ \log(|X(m_k-1)|);\ (m_k,\ \log(|X(m_k)|);\ (m_k+1, \log(|X(m_k+1)|)\}$. This results in parabola coefficients $b_k(0)$, $b_k(1)$, $b_k(2)$ of the parabola defined by $$p_k(q) = \sum_{i=0}^{2} b_k(i)\cdot q^i.$$

Figure 7:
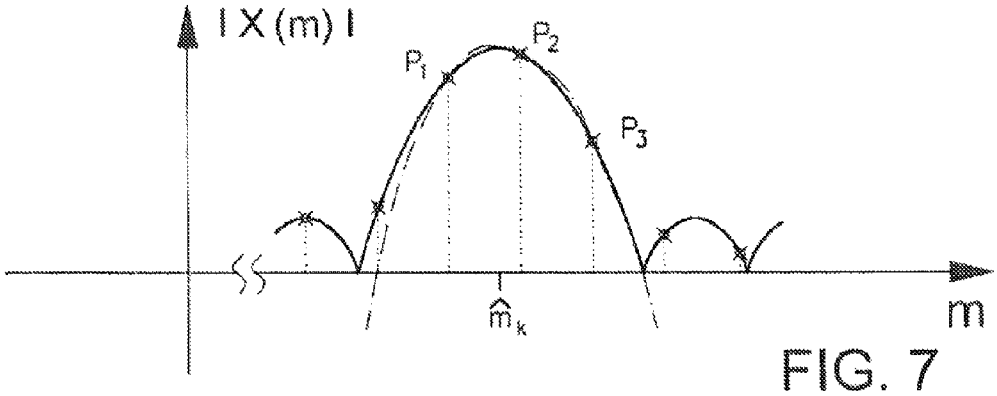
FIG. 7 illustrates a parabola fitting through DFT grid points P1, P2 and P3.

FIG. 7 illustrates the parabola fitting through DFT grid points $P_1$, $P_2$ and $P_3$.

3) For each of the K parabolas, calculating the interpolated frequency index $\hat{m}_k$ corresponding to the value of q for which the parabola has its maximum, wherein $\hat{f}_k=\hat{m}_k\cdot f_s/L$ is used as an approximation for the sinusoid frequency $f_k$.

However, embodiments of this invention further comprise enhanced frequency estimation. This may be implemented e.g. by using a main lobe approximation, a harmonic enhancement, or an interframe enhancement, and those three alternative embodiments are described below:

Main Lobe Approximation:

One limitation with the above-described parabolic interpolation arises from that the used parabolas do not approximate the shape of the main lobe of the magnitude spectrum $|W(\Omega)|$ of the window function. As a solution, this embodiment fits a function P(q), which approximates the main lobe of $$\left|W\left(\frac{2\pi}{L}\cdot q\right)\right|,$$

through the grid points of the DFT magnitude spectrum that surround the peaks and calculates the respective frequencies belonging to the function maxima. The function P(q) could be identical to the frequency-shifted magnitude spectrum $$\left|W\left(\frac{2\pi}{L}\cdot(q-\hat{q})\right)\right|$$

of the window function. For numerical simplicity it should however rather for instance be a polynomial which allows for straightforward calculation of the function maximum. The following detailed procedure is applied:

1. Identify the peaks of the DFT of the windowed analysis frame. The peak search will deliver the number of peaks K and the corresponding DFT indexes of the peaks. The peak search can typically be made on the DFT magnitude spectrum or the logarithmic DFT magnitude spectrum.

Figure 8:
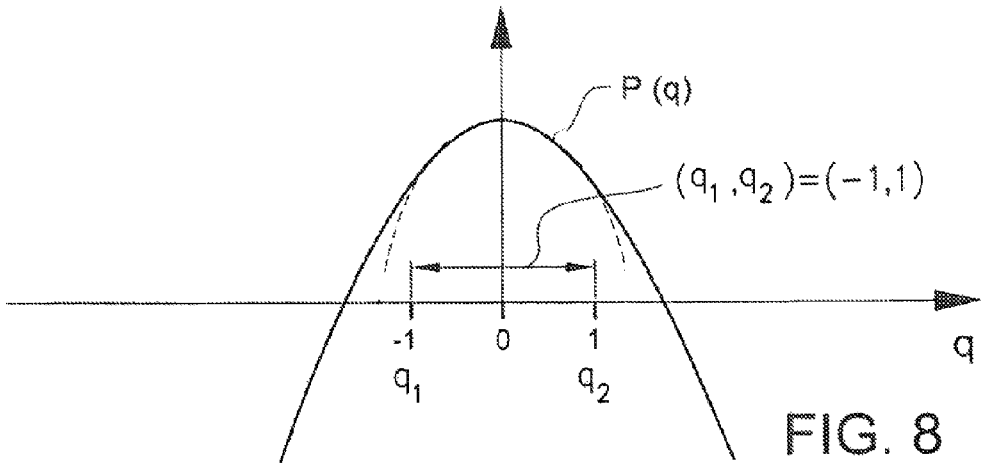
FIG. 8 illustrates a fitting of a main lobe of a window spectrum.

2. Derive the function P(q) that approximates the magnitude spectrum $$\left|W\left(\frac{2\pi}{L}\cdot q\right)\right|$$

of the window function or of the logarithmic magnitude spectrum $$\log\left|W\left(\frac{2\pi}{L}\cdot q\right)\right|$$

for a given interval $(q_1,q_2)$. FIG. 8 shows a choice of the approximation function for approximating the window spectrum main lobe, and illustrates a fitting of main lobe of window spectrum with function P(q)

3. For each peak k (with k=1 . . . K) with corresponding DFT index $m_k$ fit the frequency-shifted function $P(q-\hat{q}_k)$ through the two DFT grid points that surround the expected true peak of the continuous spectrum of the windowed sinusoidal signal. Hence, for the case of operating with the logarithmic magnitude spectrum, if $|X(m_k-1)|$ is larger than $|X(m_k+1)|$ fit $P(q-\hat{q}_k)$ through the points $\{P_1;\ P_2\}=\{(m_k-1,\ \log(|X(m_k-1);\ (m_k,\ \log(|X(m_k)|)\}$ and otherwise through the points $\{P_1;\ P_2\}=\{(m_k,\ \log(|X(m_k)|);\ (m_k+1,\ \log(|X(m_k+1)|)\}$. For the alternative example of operating with a linear rather than a logarithmic magnitude spectrum, if $X(m_k-1)|$ is larger than $|X(m_k+1)|$ fit $P(q-\hat{q}_k)$ through the points $\{P_1; P_2\}=\{(m_k-1, |X(m_k-1)|; (m_k, |X(m_k)\}$ and otherwise through the points $\{P_1; P_2\}=\{(m_k, |X(m_k); (m_k+1, |X(m_k+1)|\}$.

Figure 9:
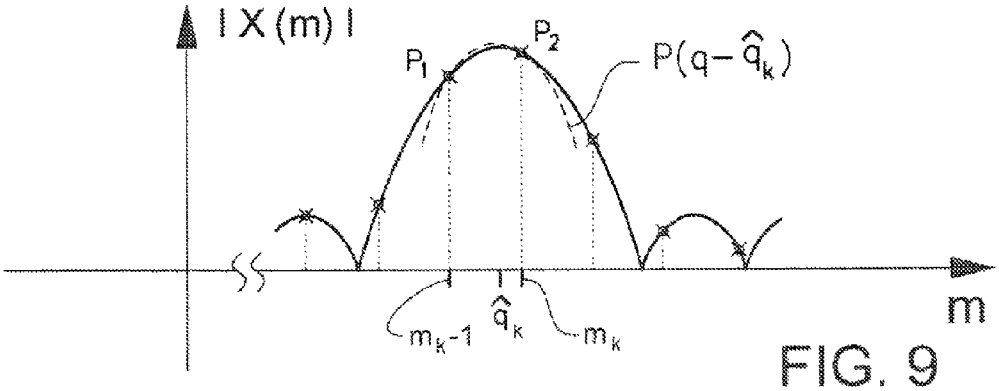
FIG. 9 illustrates a fitting of main lobe approximation function P through DFT grid points P1 and P2.

P(q) can for simplicity be chosen to be a polynomial either of order 2 or 4. This renders the approximation in step 2 a simple linear regression calculation and the calculation of $\hat{q}_k$, straightforward. The interval $(q_1,q_2)$ can be chosen to be fixed and identical for all peaks, e.g. $(q_1,q_2)=(-1,1)$, or adaptive. In the adaptive approach the interval can be chosen such that the function $P(q-\hat{q}_k)$ fits the main lobe of the window function spectrum in the range of the relevant DFT grid points $\{P_1; P_2\}$. FIG. 9 shows a visualization of the fitting process, by illustrating a fitting of main lobe approximation function P through DFT grid points $P_1$ and $P_2$.

4. For each of the K frequency shift parameters $\hat{q}_k$ for which the continuous spectrum of the windowed sinusoidal signal is expected to have its peak calculate $\hat{f}_k=\hat{q}_k \cdot f_s/L$ as approximation for the sinusoid frequency $f_k$.

Harmonic Enhancement of the Frequency Estimation:

The transmitted signal may be harmonic, which means that the signal consists of sine waves which frequencies are integer multiples of some fundamental frequency $f_0$. This is the case when the signal is very periodic like for instance for voiced speech or the sustained tones of some musical instrument. This means that the frequencies of the sinusoidal model of the embodiments are not independent but rather have a harmonic relationship and stem from the same fundamental frequency. Taking this harmonic property into account can consequently improve the analysis of the sinusoidal component frequencies substantially, and this embodiment involves the following procedure:

1. Check whether the signal is harmonic. This can for instance be done by evaluating the periodicity of signal prior to the frame loss. One straightforward method is to perform an autocorrelation analysis of the signal. The maximum of such autocorrelation function for some time lag $\tau>0$ can be used as an indicator. If the value of this maximum exceeds a given threshold, the signal can be regarded harmonic. The corresponding time lag $\tau$ then corresponds to the period of the signal which is related to the fundamental frequency through $$f_0 = \frac{f_s}{\tau}.$$

Many linear predictive speech coding methods apply so-called open or closed-loop pitch prediction or CELP coding using adaptive codebooks. The pitch gain and the associated pitch lag parameters derived by such coding methods are also useful indicators if the signal is harmonic and, respectively, for the time lag.

A further method is described below:

2. For each harmonic index j within the integer range $1 \ldots J_{max}$ check whether there is a peak in the (logarithmic) DFT magnitude spectrum of the analysis frame within the vicinity of the harmonic frequency $f_j=j \cdot f_0$. The vicinity of $f_j$ may be defined as the delta range around $f_j$ where delta corresponds to the frequency resolution of the DFT $$\frac{f_s}{L},$$

i.e. the interval $$\left[j \cdot f_0 - \frac{f_s}{2 \cdot L}, j \cdot f_0 + \frac{f_s}{2 \cdot L}\right].$$

In case such a peak with corresponding estimated sinusoidal frequency $\hat{f}_k$ is present, supersede $\hat{f}_k$ by $\hat{\hat{f}}_k=j \cdot f_0$.

For the procedure given above there is also the possibility to make the check whether the signal is harmonic and the derivation of the fundamental frequency implicitly and possibly in an iterative fashion without necessarily using indicators from some separate method. An example for such a technique is given as follows:

For each $f_{0,p}$ out of a set of candidate values $\{f_{0,1} \ldots f_{0,P}\}$ apply the procedure 2 described above, though without superseding $\hat{f}_k$ but with counting how many DFT peaks are present within the vicinity around the harmonic frequencies, i.e. the integer multiples of $f_{0,p}$. Identify the fundamental frequency $f_{0,p_{max}}$ for which the largest number of peaks at or around the harmonic frequencies is obtained. If this largest number of peaks exceeds a given threshold, then the signal is assumed to be harmonic. In that case $f_{0,p_{max}}$ can be assumed to be the fundamental frequency with which procedure 2 is then executed leading to enhanced sinusoidal frequencies $\hat{\hat{f}}_k$.. A more preferable alternative is however first to optimize the fundamental frequency estimate $f_0$ based on the peak frequencies $\hat{f}_k$ that have been found to coincide with harmonic frequencies. Assume a set of M harmonics, i.e. integer multiples $\{n_1 \ldots n_M\}$ of some fundamental frequency that have been found to coincide with some set of M spectral peaks at frequencies $\hat{f}_{k(m)}$,m=1 . . . M, then the underlying (optimized) fundamental frequency estimate $f_{0,opt}$ can be calculated to minimize the error between the harmonic frequencies and the spectral peak frequencies. If the error to be minimized is the mean square error $$E_2 = \sum_{m=1}^{M} \left(n_m \cdot f_0 - \hat{f}_{k(m)}\right)^2,$$

then the optimal fundamental frequency estimate is calculated as $$f_{0,opt} = \frac{\sum_{m=1}^{M} n_m \cdot \hat{f}_{k(m)}}{\sum_{m=1}^{M} n_m^2}.$$

The initial set of candidate values $\{f_{0,1} \ldots f_{0,P}\}$ can be obtained from the frequencies of the DFT peaks or the estimated sinusoidal frequencies $\hat{f}_k$.

Interframe Enhancement of Frequency Estimation:

According to this embodiment, the accuracy of the estimated sinusoidal frequencies $\vec{f}_k$ is enhanced by considering their temporal evolution. Thus, the estimates of the sinusoidal frequencies from a multiple of analysis frames is combined for instance by means of averaging or prediction. Prior to averaging or prediction a peak tracking is applied that connects the estimated spectral peaks to the respective same underlying sinusoids.

Applying a Sinusoidal Model

The application of a sinusoidal model in order to perform a frame loss concealment operation according to embodiments may be described as follows:

In case a given segment of the coded signal cannot be reconstructed by the decoder since the corresponding encoded information is not available, i.e. since a frame has been lost, an available part of the signal prior to this segment may be used as prototype frame. If y(n) with n=0 . . . N−1 is the unavailable segment for which a substitution frame z(n) has to be generated, and y(n) with n<0 is the available previously decoded signal, a prototype frame of the available signal of length L and start index $n_{-1}$ is extracted with a window function w(n) and transformed into frequency domain, e.g. by means of DFT:

$$Y_{-1}(m) = \sum_{n=0}^{L-1} y(n - n_{-1}) \cdot w(n) \cdot e^{-j\frac{2\pi}{L}nm}$$

The window function can be one of the window functions described above in the sinusoidal analysis. Preferably, in order to save numerical complexity, the frequency domain transformed frame should be identical with the one used during sinusoidal analysis, which means that the analysis frame and the prototype frame will be identical, and likewise their respective frequency domain transforms.

In a next step the sinusoidal model assumption is applied. According to the sinusoidal model assumption, the DFT of the prototype frame can be written as follows:

$$Y_{-1}(m) = \frac{1}{2}\sum_{k=1}^{K} a_k \cdot \left(\left(W\left(2\pi\left(\frac{m}{L} + \frac{f_k}{f_s}\right)\right) \cdot e^{-j\varphi_k} + W\left(2\pi\left(\frac{m}{L} - \frac{f_k}{f_s}\right)\right) \cdot e^{j\varphi_k}\right)\right).$$

This expression was also used in the analysis part and is described in detail above.

Figure 3:
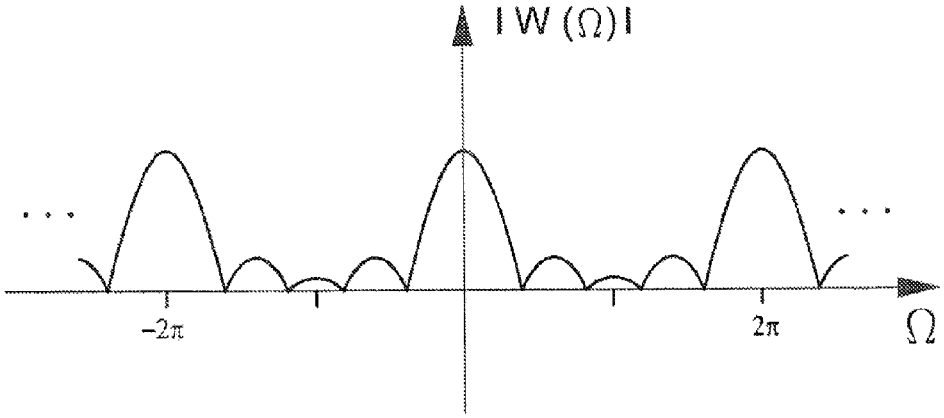
FIG. 3 displays an example of a magnitude spectrum of a window function.

Next, it is realized that the spectrum of the used window function has only a significant contribution in a frequency range close to zero. As illustrated in FIG. 3 the magnitude spectrum of the window function is large for frequencies close to zero and small otherwise (within the normalized frequency range from −π to π, corresponding to half the sampling frequency). Hence, as an approximation it is assumed that the window spectrum W(m) is non-zero only for an interval $M=[-m_{min}, m_{max}]$ with $m_{min}$ and $m_{max}$ being small positive numbers. In particular, an approximation of the window function spectrum is used such that for each k the contributions of the shifted window spectra in the above expression are strictly non-overlapping. Hence in the above equation for each frequency index there is always only at maximum the contribution from one summand, i.e. from one shifted window spectrum. This means that the expression above reduces to the following approximate expression:

$$\hat{Y}_{-1}(m) = \frac{a_k}{2} \cdot W\left(2\pi\left(\frac{m}{L} - \frac{f_k}{f_s}\right)\right) \cdot e^{j\varphi_k}$$

for non-negative $m \in M_k$ and for each k.

Herein, $M_k$ denotes the integer interval $$M_k = \left[\text{round}\left(\frac{f_k}{f_s} \cdot L\right) - m_{min,k},\ \text{round}\left(\frac{f_k}{f_s} \cdot L\right) + m_{max,k}\right],$$

where $m_{min,k}$ and $m_{max,k}$ fulfill the above explained constraint such that the intervals are not overlapping. A suitable choice for $m_{min,k}$ and $m_{max,k}$ is to set them to a small integer value δ, e.g. δ=3. If however the DFT indices related to two neighboring sinusoidal frequencies $f_k$ and $f_{k+1}$ are less than 2δ, then δ is set to $$\text{floor}\left(\frac{\text{round}\left(\frac{f_{k+1}}{f_s} \cdot L\right) - \text{round}\left(\frac{f_k}{f_s} \cdot L\right)}{2}\right)$$

such that it is ensured that the intervals are not overlapping. The function floor(•) is the closest integer to the function argument that is smaller or equal to it.

The next step according to embodiments is to apply the sinusoidal model according to the above expression and to evolve its K sinusoids in time. The assumption that the time indices of the erased segment compared to the time indices of the prototype frame differs by $n_{-1}$ samples means that the phases of the sinusoids advance by $$\theta_k = 2\pi \cdot \frac{f_k}{f_s} n_{-1}.$$

Hence, the DFT spectrum of the evolved sinusoidal model is given by:

$$Y_0(m) = \frac{1}{2}\sum_{k=1}^{K} a_k \cdot \left(\left(W\left(2\pi\left(\frac{m}{L} + \frac{f_k}{f_s}\right)\right) \cdot e^{-j(\varphi_k+\theta_k)} + W\left(2\pi\left(\frac{m}{L} - \frac{f_k}{f_s}\right)\right) \cdot e^{j(\varphi_k+\theta_k)}\right)\right).$$

Applying again the approximation according to which the shifted window function spectra do no overlap gives:

$$\hat{Y}_0(m) = \frac{a_k}{2} \cdot W\left(2\pi\left(\frac{m}{L} - \frac{f_k}{f_s}\right)\right) \cdot e^{j(\phi_k+\theta_k)}$$

for non-negative $m \in M_k$ and for each k.

Comparing the DFT of the prototype frame $Y_{-1}(m)$ with the DFT of evolved sinusoidal model $Y_0(m)$ by using the approximation, it is found that the magnitude spectrum remains unchanged while the phase is shifted by $$\theta_k = 2\pi \cdot \frac{f_k}{f_s} n_{-1},$$

for each $m \in M_k$.

Hence, the substitution frame can be calculated by the following expression:

$z(n)=\text{IDFT}\{Z(m)\}$ with $Z(m)=Y(m)\cdot e^{j\theta_k}$ for non-negative $m \in M_k$ and for each $k$.

A specific embodiment addresses phase randomization for DFT indices not belonging to any interval $M_k$. As described above, the intervals $M_k$, k=1 . . . K, have to be set such that they are strictly non-overlapping which is done using some parameter δ which controls the size of the intervals. It may happen that δ is small in relation to the frequency distance of two neighboring sinusoids. Hence, in that case it happens that there is a gap between two intervals. Consequently, for the corresponding DFT indices m no phase shift according to the above expression $Z(m)=Y(m)\cdot e^{j\theta_k}$ is defined. A suitable choice according to this embodiment is to randomize the phase for these indices, yielding $Z(m)=Y(m)\cdot e^{j2\pi rand(\bullet)}$, where the function rand(•) returns some random number.

Adapting the Size of the Intervals $M_k$ in Response to the Tonality the Signal

One embodiment of this invention comprises adapting the size of the intervals $M_k$ in response to the tonality the signal. This adapting may be combined with the enhanced frequency estimation described above, which uses e.g. a main lobe approximation, a harmonic enhancement, or an interframe enhancement. However, an adapting of the size of the intervals $M_k$ in response to the tonality the signal may alternatively be performed without any preceding enhanced frequency estimation.

It has been found beneficial for the quality of the reconstructed signals to optimize the size of the intervals $M_k$. In particular, the intervals should be larger if the signal is very tonal, i.e. when it has clear and distinct spectral peaks. This is the case for instance when the signal is harmonic with a clear periodicity. In other cases where the signal has less pronounced spectral structure with broader spectral maxima, it has been found that using small intervals leads to better quality. This finding leads to a further improvement according to which the interval size is adapted according to the properties of the signal. One realization is to use a tonality or a periodicity detector. If this detector identifies the signal as tonal, the δ-parameter controlling the interval size is set to a relatively large value. Otherwise, the δ-parameter is set to relatively smaller values.

Figure 10:
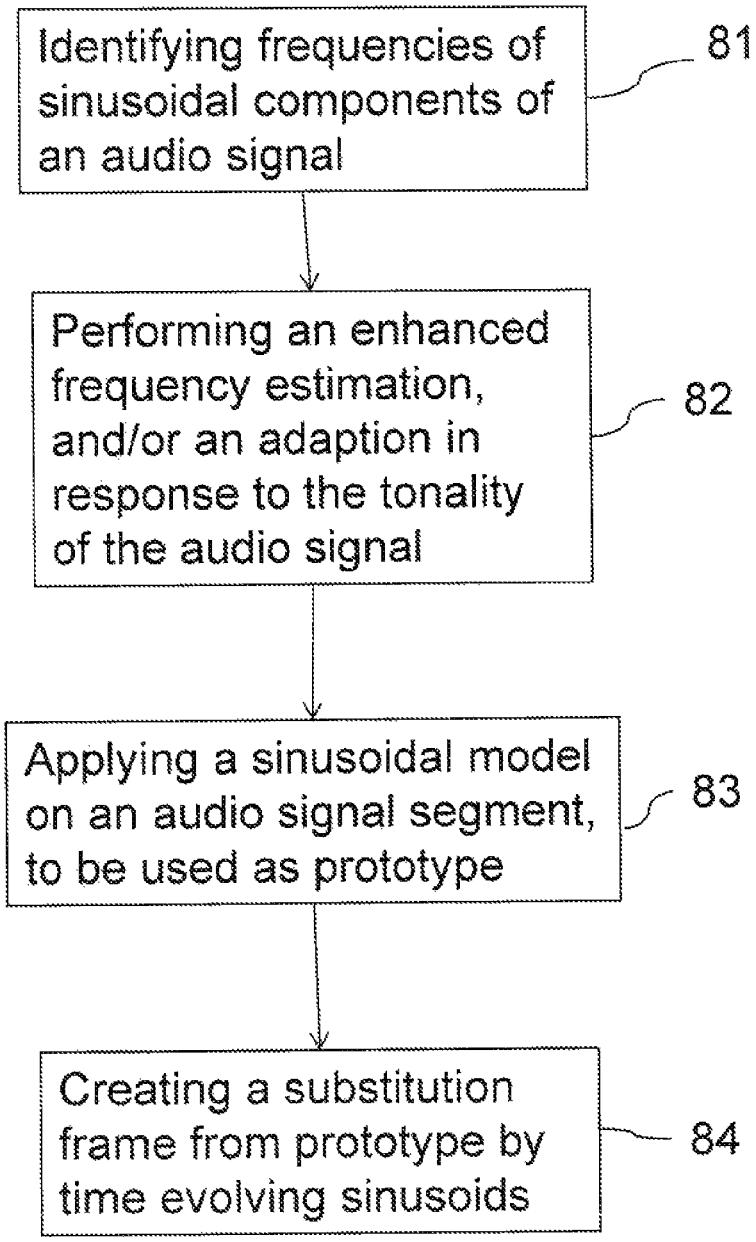
FIG. 10 is a flow chart of a method according to embodiments.

Based on the above, FIG. 10 is a flow chart illustrating an exemplary audio frame loss concealment method according to embodiments:

A sinusoidal analysis of a part of a previously received or reconstructed audio signal is performed, wherein the sinusoidal analysis involves identifying 81 frequencies of sinusoidal components, i.e. sinusoids, of the audio signal. In step 83, a sinusoidal model is applied on a segment of the previously received or reconstructed audio signal, wherein said segment is used as a prototype frame in order to create a substitution frame for a lost audio frame, and in step 84 the substitution frame for the lost audio frame is created, involving time-evolution of sinusoidal components, i.e. sinusoids, of the prototype frame, up to the time instance of the lost audio frame, in response to the corresponding identified frequencies. However, the step of identifying 81 frequencies of sinusoidal components and/or the step of creating 84 the substitution frame may further comprise performing, as indicated in step 82, at least one of an enhanced frequency estimation in the identifying 81 of frequencies, and an adaptation of the creating 84 of the substitution frame in response to the tonality of the audio signal. The enhanced frequency estimation comprises at least one of a main lobe approximation a harmonic enhancement, and an interframe enhancement.

According to a further embodiment, it is assumed that the audio signal is composed of a limited number of individual sinusoidal components.

According to an exemplary embodiment, the method comprises extracting a prototype frame from an available previously received or reconstructed signal using a window function, and wherein the extracted prototype frame may be transformed into a frequency domain representation.

According to a first alternative embodiment, the enhanced frequency estimation comprises approximating the shape of a main lobe of a magnitude spectrum related to a window function, and it may further comprise identifying one or more spectral peaks, k, and the corresponding discrete frequency domain transform indexes $m_k$ associated with an analysis frame; deriving a function P(q) that approximates the magnitude spectrum related to the window function, and for each peak, k, with a corresponding discrete frequency domain transform index $m_k$, fitting a frequency-shifted function $P(q-q_k)$ through two grid points of the discrete frequency domain transform surrounding an expected true peak of a continuous spectrum of an assumed sinusoidal model signal associated with the analysis frame.

According to a second alternative embodiment, the enhanced frequency estimation is a harmonic enhancement, comprising determining whether the audio signal is harmonic, and deriving a fundamental frequency, if the signal is harmonic. The determining may comprise at least one of performing an autocorrelation analysis of the audio signal and using a result of a closed-loop pitch prediction, e.g. the pitch gain.

The step of deriving may comprise using a further result of a closed-loop pitch prediction, e.g. the pitch lag. Further according to this second alternative embodiment, the step of deriving may comprise checking, for a harmonic index j, whether there is a peak in a magnitude spectrum within the vicinity of a harmonic frequency associated with said harmonic index and a fundamental frequency, the magnitude spectrum being associated with the step of identifying.

According to a third alternative embodiment, the enhanced frequency estimation is an interframe enhancement, comprising combining identified frequencies from two or more audio signal frames. The combining may comprise an averaging and/or a prediction, and a peak tracking may be applied prior to the averaging and/or prediction.

According to an embodiment, the adaptation in response to the tonality of the audio signal involves adapting a size of an interval $M_k$ located in the vicinity of a sinusoidal component k, depending on the tonality of the audio signal. Further, the adapting of the size of an interval may comprise increasing the size of the interval for an audio signal having comparatively more distinct spectral peaks, and reducing the size of the interval for an audio signal having comparatively broader spectral peaks.

The method according to embodiments may comprise time-evolving sinusoidal components of a frequency spectrum of a prototype frame by advancing the phase of a sinusoidal component, in response to the frequency of this sinusoidal component and in response to the time difference between the lost audio frame and the prototype frame. It may further comprise changing a spectral coefficient of the prototype frame included in the interval $M_k$ located in the vicinity of a sinusoid k by a phase shift proportional to the sinusoidal frequency $f_k$ and the time difference between the lost audio frame and the prototype frame.

Embodiments may also comprise an inverse frequency domain transform of the frequency spectrum of the prototype frame, after the above-described changes of the spectral coefficients.

More specifically, the audio frame loss concealment method according to a further embodiment may involve the following steps:

1) Analyzing a segment of the available, previously synthesized signal to obtain the constituent sinusoidal frequencies $f_k$ of a sinusoidal model.

2) Extracting a prototype frame $y_{-1}$ from the available previously synthesized signal and calculate the DFT of that frame.

3) Calculating the phase shift $\theta_k$ for each sinusoid k in response to the sinusoidal frequency $f_k$ and the time advance $n_{-1}$ between the prototype frame and the substitution frame, wherein the size of the interval $M_k$ may have been adapted in response to the tonality of the audio signal.

4) For each sinusoid k advancing the phase of the prototype frame DFT with $\theta_k$ selectively for the DFT indices related to a vicinity around the sinusoid frequency $f_k$.

5) Calculating the inverse DFT of the spectrum obtained 4).

The embodiments describe above may be further explained by the following assumptions:

a) The assumption that the signal can be represented by a limited number of sinusoids.

b) The assumption that the substitution frame is sufficiently well represented by these sinusoids evolved in time, in comparison to some earlier time instant.

c) The assumption of an approximation of the spectrum of a window function such that the spectrum of the substitution frame can be built up by non-overlapping portions of frequency shifted window function spectra, the shift frequencies being the sinusoid frequencies.

Figure 11:
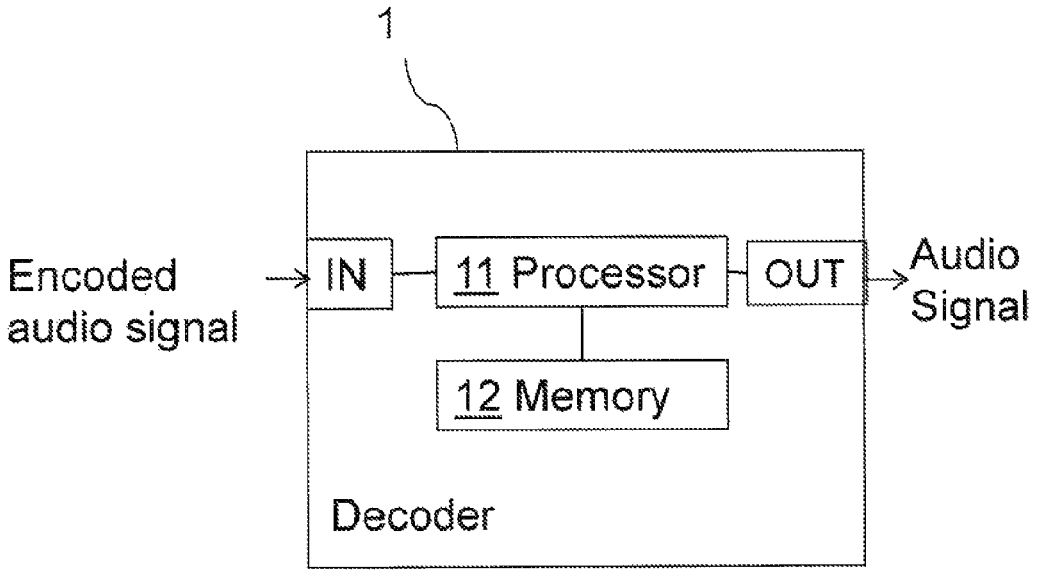
FIGS. 11 and 12 both illustrate a decoder according to embodiments.

FIG. 11 is a schematic block diagram illustrating an exemplary decoder 1 configured to perform a method of audio frame loss concealment according to embodiments. The illustrated decoder comprises one or more processors 11 and adequate software with suitable storage or memory 12. The incoming encoded audio signal is received by an input (IN), to which the processor 11 and the memory 12 are connected. The decoded and reconstructed audio signal obtained from the software is outputted from the output (OUT), whereby the decoder is configured to:

perform a sinusoidal analysis of a part of a previously received or reconstructed audio signal, wherein the sinusoidal analysis involves identifying frequencies of sinusoidal components of the audio signal;

apply a sinusoidal model on a segment of the previously received or reconstructed audio signal, wherein said segment is used as a prototype frame in order to create a substitution frame for a lost audio frame;

create the substitution frame for the lost audio frame by time-evolving sinusoidal components of the prototype frame, up to the time instance of the lost audio frame, in response to the corresponding identified frequencies; and perform at least one of an enhanced frequency estimation in the identifying of frequencies, and an adaptation of the creating of the substitution frame in response to the tonality of the audio signal, wherein the enhanced frequency estimation comprises at least one of a main lobe approximation, a harmonic enhancement, and an interframe enhancement.

According to an embodiment of the decoder, the applied sinusoidal model assumes that the audio signal is composed of a limited number of individual sinusoidal components.

According to a further embodiment, the decoder is configured to extract a prototype frame from an available previously received or reconstructed signal using a window function, and to transform the extracted prototype frame into a frequency domain.

According to an alternative embodiment, the enhanced frequency estimation comprises approximating the shape of a main lobe of a magnitude spectrum related to a window function, and the decoder may be configured to:

identify one or more spectral peaks, k, and the corresponding discrete frequency domain transform indexes $m_k$ associated with an analysis frame;

derive a function P(q) that approximates the magnitude spectrum related to the window function, and for each peak, k, with a corresponding discrete frequency domain transform index $m_1$, fit a frequency-shifted function $P(q-q_k)$ through two grid points of the discrete frequency domain transform surrounding an expected true peak of a continuous spectrum of an assumed sinusoidal model signal associated with the analysis frame.

According to a second alternative embodiment, the enhanced frequency estimation is a harmonic enhancement, and the decoder is configured to:

determine whether the audio signal is harmonic, derive a fundamental frequency, if the signal is harmonic.

Further, the determining may comprise at least one of an autocorrelation analysis of the audio signal, and a use of a result of a closed-loop pitch prediction, and the deriving may use a further result of a closed-loop pitch prediction.

The deriving may further comprise checking, for a harmonic index j, whether there is a peak in a magnitude spectrum within the vicinity of a harmonic frequency associated with said harmonic index and a fundamental frequency, the magnitude spectrum being associated with the step of identifying.

According to a third alternative embodiment, the enhanced frequency estimation is an interframe enhancement, and the decoder is configured to combine identified frequencies from two or more audio signal frames. Further, the combining may comprise an averaging and/or a prediction, wherein the decoder is configured to apply a peak tracking prior to the averaging and/or prediction.

According to an embodiment, the decoder is configured to perform the adaptation in response to the tonality of the audio signal by adapting a size of an interval $M_k$ located in the vicinity of a sinusoidal component k, depending on the tonality of the audio signal.

Further, the decoder may be configured to adapt of the size of an interval by increasing the size of the interval for an audio signal having comparatively more distinct spectral peaks, and reducing the size of the interval for an audio signal having comparatively broader spectral peaks.

According to a still further embodiment, the decoder is configured to time-evolve sinusoidal components of a frequency spectrum of a prototype frame by advancing the phase of the sinusoidal components, in response to the frequency of each sinusoidal component and in response to the time difference between the lost audio frame and the prototype frame. The decoder may be further configured to change a spectral coefficient of the prototype frame included in the interval $M_k$ located in the vicinity of a sinusoid k by a phase shift proportional to the sinusoidal frequency $f_k$ and the time difference between the lost audio frame and the prototype frame, and to create the substitution frame by performing an inverse frequency transform of the frequency spectrum.

Figure 12A:
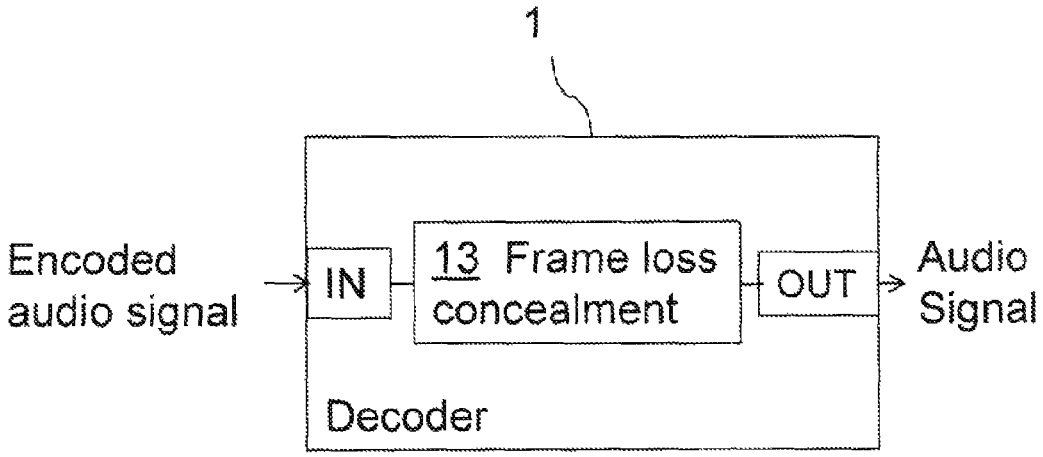
Figure 12B:
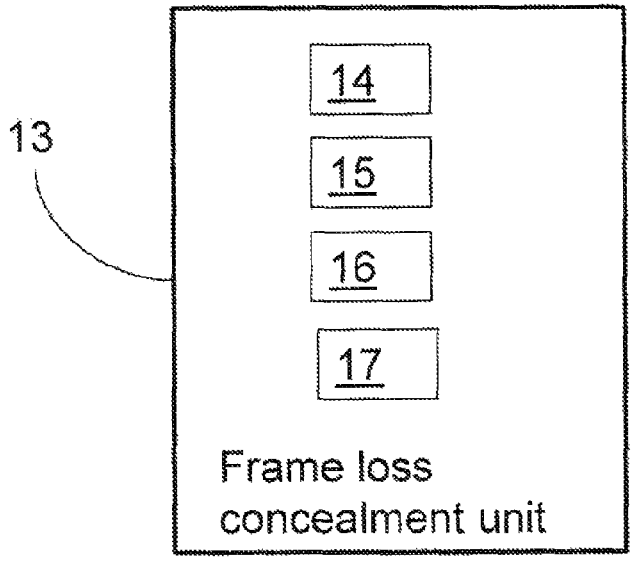

A decoder according to an alternative embodiment is illustrated in FIG. 12*a*, comprising an input unit configured to receive an encoded audio signal. The figure illustrates the frame loss concealment by a logical frame loss concealment-unit 13, wherein the decoder 1 is configured to implement a concealment of a lost audio frame according to embodiments described above. The logical frame loss concealment unit 13 is further illustrated in FIG. 12*b*, and it comprises suitable means for concealing a lost audio frame, i.e. means 14 for performing a sinusoidal analysis of a part of a previously received or reconstructed audio signal, wherein the sinusoidal analysis involves identifying frequencies of sinusoidal components of the audio signal, means 15 for applying a sinusoidal model on a segment of the previously received or reconstructed audio signal, wherein said segment is used as a prototype frame in order to create a substitution frame for a lost audio frame, means 16 for creating the substitution frame for the lost audio frame by time-evolving sinusoidal components of the prototype frame, up to the time instance of the lost audio frame, in response to the corresponding identified frequencies, and means 17 for performing at least one of an enhanced frequency estimation and an adaptation of the creating of the substitution frame in response to the tonality of the audio signal, wherein the enhanced frequency estimation comprises at least one of a main lobe approximation, a harmonic enhancement, and an interframe enhancement.

The units and means included in the decoder illustrated in the figures may be implemented at least partly in hardware, and there are numerous variants of circuitry elements that can be used and combined to achieve the functions of the units of the decoder. Such variants are encompassed by the embodiments. A particular example of hardware implementation of the decoder is implementation in digital signal processor (DSP) hardware and integrated circuit technology, including both general-purpose electronic circuitry and application-specific circuitry.

Figure 13:
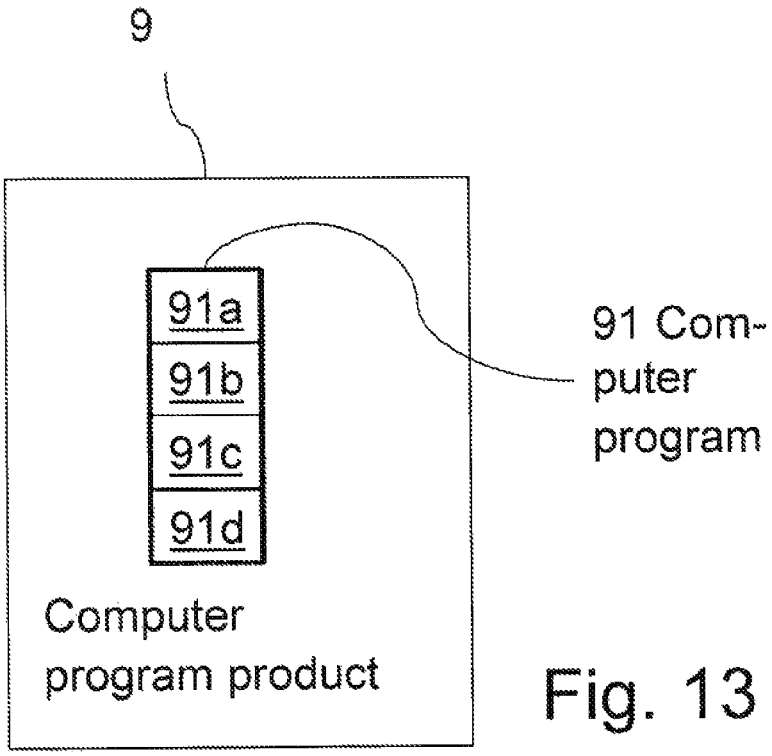
FIG. 13 illustrates a computer program and a computer program product, according to embodiments.

A computer program according to embodiments of the present invention comprises instructions which when run by a processor causes the processor to perform a method according to a method described in connection with FIG. 10. FIG. 13 illustrates a computer program product 9 according to embodiments, in the form of a non-volatile memory, e.g. an EEPROM (Electrically Erasable Programmable Read-Only Memory), a flash memory or a disk drive. The computer program product comprises a computer readable medium storing a computer program 91, which comprises computer program modules 91*a,b,c,d* which when run on a decoder 1 causes a processor of the decoder to perform the steps according to FIG. 10.

A decoder according to embodiments of this invention may be used e.g. in a receiver for a mobile device, e.g. a mobile phone or a laptop, or in a receiver for a stationary device, e.g. a personal computer.

Advantages of the embodiments described herein are to provide a frame loss concealment method allowing mitigating the audible impact of frame loss in the transmission of audio signals, e.g. of coded speech. A general advantage is to provide a smooth and faithful evolution of the reconstructed signal for a lost frame, wherein the audible impact of frame losses is greatly reduced in comparison to conventional techniques.

It is to be understood that the choice of interacting units or modules, as well as the naming of the units are only for exemplary purpose, and may be configured in a plurality of alternative ways in order to be able to execute the disclosed process actions. It should also be noted that the units or modules described in this disclosure are to be regarded as logical entities and not with necessity as separate physical entities. It will be appreciated that the scope of the technology disclosed herein fully encompasses other embodiments which may become obvious to those skilled in the art, and that the scope of this disclosure is accordingly not to be limited.

The invention claimed is:

1. A method of concealing a lost audio frame of a received audio signal, the method comprising:

performing a sinusoidal analysis of a previously received or reconstructed part of the received audio signal, wherein the sinusoidal analysis comprises identifying frequencies of sinusoidal components of the previously received or reconstructed part by performing an enhanced frequency estimation comprising determining whether the previously received or reconstructed part is harmonic by performing at least one of an autocorrelation analysis of the received audio signal and using a result of a closed-loop pitch prediction;

applying a sinusoidal model on a segment of the previously received or reconstructed part of the received audio signal, wherein the segment is used as a prototype frame in order to create a substitution frame for a lost audio frame; and creating the substitution frame for the lost audio frame, wherein the creating comprises time-evolving sinusoidal components of the prototype frame, up to a time instance of the lost audio frame, based at least in part on the frequencies of the sinusoidal components, wherein the time-evolving comprises changing a spectral coefficient of the prototype frame included in an interval located in a vicinity of a sinusoid by a phase shift proportional to a sinusoidal frequency and a time difference between the lost audio fame and the prototype frame, while retaining a magnitude of the spectral coefficient, and wherein the creating is based on a tonality of the received audio signal.

2. The method according to claim 1, wherein the received audio signal comprises a number of individual sinusoidal components.

3. The method according to claim 1, further comprising extracting the prototype frame from an available previously received or reconstructed part of the received audio signal using a window function.

4. The method according to claim 3, further comprising transforming the extracted prototype frame into a frequency domain representation.

5. The method according to claim 1, wherein the enhanced frequency estimation comprises approximating a shape of a main lobe of a magnitude spectrum related to a window function.

6. The method according to claim 5, comprising:

identifying one or more spectral peaks, k, and corresponding discrete frequency domain transform indexes $m_k$ associated with an analysis frame;

deriving a function that approximates the magnitude spectrum related to the window function, and fitting, for each spectral peak and a corresponding discrete frequency domain transform index, a frequency-shifted function based on the function through two grid points of a discrete frequency domain transform surrounding an expected true peak of a continuous spectrum of a sinusoidal model signal associated with the analysis frame.

7. The method according to claim 1, further comprising:

deriving a fundamental frequency, if the received audio signal is harmonic.

8. The method according to claim 7, wherein the deriving comprises using a further result of a closed-loop pitch prediction.

9. The method according to claim 7, wherein the step of deriving comprises checking, for a harmonic index, whether there is a peak in a magnitude spectrum within a vicinity of a harmonic frequency associated with said harmonic index and a fundamental frequency.

10. The method according to claim 1, wherein the enhanced frequency estimation comprises combining identified frequencies from two or more audio signal frames.

11. The method according to claim 10, wherein the combining comprises an averaging and/or a prediction, and wherein a peak tracking is applied prior to the averaging and/or the prediction.

12. The method according to claim 1, wherein the creating based on the tonality of the received audio signal comprises adapting a size of an interval located in a vicinity of a sinusoidal component k, depending on the tonality of the received audio signal.

13. The method according to claim 12, wherein the adapting of the size of the interval comprises selecting the size of the interval based on a number of distinct spectral peaks or a shape of distinct spectral peaks.

14. The method according to claim 1, further comprising time-evolving sinusoidal components of a frequency spectrum of the prototype frame by advancing a phase of a respective one of the sinusoidal components, in response to the frequency of respective one, and in response to a time difference between the lost audio frame and the prototype frame.

15. The method according to claim 1, further comprising performing an inverse frequency domain transform of a frequency spectrum of the prototype frame.

16. A computer program product comprising a non-transitory computer readable storage medium storing instructions which, when run by a processor, causes the processor to perform a method according to claim 1.

17. The method according to claim 1, further comprising: outputting the substitution frame via an output.

18. A decoder configured to conceal a lost audio frame of a received audio signal, the decoder comprising a processor and memory, the memory comprising instructions executable by the processor that, when executed by the processor, cause the processor to:

perform a sinusoidal analysis of a previously received or reconstructed part of the received audio signal, wherein the sinusoidal analysis comprises identifying frequencies of sinusoidal components of the previously received or reconstructed part of the received audio signal by performing an enhanced frequency estimation comprising determining whether the previously received or reconstructed part is harmonic by performing at least one of an autocorrelation analysis of the received audio signal and using a result of a closed-loop pitch prediction;

apply a sinusoidal model on a segment of the previously received or reconstructed part of the received audio signal, wherein the segment is used as a prototype frame in order to create a substitution frame for the lost audio frame; and create the substitution frame for the lost audio frame by time-evolving sinusoidal components of the prototype frame, up to a time instance of the lost audio frame, based on the frequencies of the sinusoidal components and a tonality of the received audio signal, wherein the time-evolving comprises changing a spectral coefficient of the prototype frame included in an interval located in a vicinity of a sinusoid by a phase shift proportional to a sinusoidal frequency and a time difference between the lost audio frame and the prototype frame, while retaining a magnitude of the spectral coefficient.

19. The decoder according to claim 18, wherein the received audio signal comprises a number of individual sinusoidal components.

20. The decoder according to claim 18, wherein the memory comprises further instructions that when executed by the processor cause the processor to extract a prototype frame from the previously received or reconstructed part of the received audio signal using a window function.

21. The decoder according to claim 20, wherein the memory comprises further instructions that when executed by the processor cause the processor to transform the extracted prototype frame into a frequency domain.

22. The decoder according to claim 18, wherein performing the enhanced frequency estimation comprises approximating a shape of a main lobe of a magnitude spectrum related to a window function.

23. The decoder according to claim 22, wherein the memory comprises further instructions that when executed by the processor cause the processor to:

identify one or more spectral peaks, and corresponding discrete frequency domain transform indexes associated with an analysis frame;

derive a function that approximates the magnitude spectrum related to the window function, and for each peak and corresponding discrete frequency domain transform index, fit a frequency-shifted function based on the function through two grid points of a discrete frequency domain transform surrounding an expected true peak of a continuous spectrum of a sinusoidal model signal associated with the analysis frame.

24. The decoder according to claim 18, wherein performing the enhanced frequency estimation comprises performing a harmonic enhancement, and wherein the memory comprises further instructions that when executed by the processor cause the processor to:

derive a fundamental frequency, if the received audio signal is harmonic.

25. The decoder according to claim 24, wherein deriving comprises using a further result of a closed-loop pitch prediction.

26. The decoder according to claim 24, wherein deriving comprises checking, for a harmonic index, whether there is a peak in a magnitude spectrum within a vicinity of a harmonic frequency associated with said harmonic index and a fundamental frequency.

27. The decoder according to claim 18, wherein performing the enhanced frequency estimation comprises combining identified frequencies from two or more audio signal frames.

28. The decoder according to claim 27, wherein the combining comprises an averaging and/or a prediction, and wherein the memory comprises instructions that when executed by the processor cause the processor to apply peak tracking prior to the averaging and/or the prediction.

29. The decoder according to claim 18, wherein the instructions that when executed by the processor cause the processor to create the substitution frame based on the tonality of the received audio signal comprise instructions that cause the processor to adapt a size of an interval located in a vicinity of a sinusoidal component depending on the tonality of the received audio signal.

30. The decoder according to claim 29, wherein the instructions that cause the processor to adapt of the size of an interval comprise instructions to adjust the size of the interval based on a number of distinct spectral peaks or a shape of distinct spectral peaks in the received audio signal.

31. The decoder according to claim 30, wherein the memory comprises further instructions that when executed by the processor cause the processor to time-evolve sinusoidal components of a frequency spectrum of the prototype frame by advancing a phase of a respective one of the sinusoidal components, in response to a frequency of the respective one of the sinusoidal components and in response to a time difference between the lost audio frame and the prototype frame.

32. The decoder according to claim 31, wherein the memory comprises further instructions that when executed by the processor cause the processor to create the substitution frame by performing an inverse frequency transform of a frequency spectrum of the prototype frame.

33. A receiver comprising a decoder according to claim 18.

34. The decoder according to claim 18, wherein the decoder further comprises an output and wherein the memory comprises further instructions that when executed by the processor cause the processor to transmit an output signal comprising the substitution frame via the output.

35. A decoder configured to conceal a lost audio frame of a received audio signal, the decoder comprising an input circuit configured to receive an encoded audio signal, and a frame loss concealment circuit configured to:

perform a sinusoidal analysis of a previously received or reconstructed part of the received audio signal, wherein the sinusoidal analysis involves identifying frequencies of sinusoidal components of the previously received or reconstructed part of the received audio signal by performing an enhanced frequency estimation comprising determining whether the previously received or reconstructed part is harmonic by performing at least one of an autocorrelation analysis of the received audio signal and using a result of a closed-loop pitch prediction;

apply a sinusoidal model on a segment of the previously received or reconstructed part of the received audio signal, wherein said segment is used as a prototype frame in order to create a substitution frame for a lost audio frame; and create the substitution frame for the lost audio frame by time-evolving sinusoidal components of the prototype frame, up to a time instance of the lost audio frame, based on the frequencies of the sinusoidal components and based on a tonality of the received audio signal, wherein the time-evolving comprises changing a spectral coefficient of the prototype frame included in an interval located in a vicinity of a sinusoid by a phase shift proportional to a sinusoidal frequency and a time difference between the lost audio frame and the prototype frame, while retaining a magnitude of the spectral coefficient.

* * * * *